United States Patent [19]

Loeber

[11] 4,035,577

[45] July 12, 1977

[54] TUBULAR FERRULE

[75] Inventor: Donald E. Loeber, Closter, N.J.

[73] Assignee: Thomas & Betts Corporation, Elizabeth, N.J.

[21] Appl. No.: 366,747

[22] Filed: June 4, 1973

[51] Int. Cl.[2] ..... H01R 5/10

[52] U.S. Cl. ..... 174/84 C; 16/108; 140/76; 174/87

[58] Field of Search ..... 174/87, 84 C, 84 R, 174/94 R; 339/98, 97 R, 97 C, 276 R; 16/108, 109; 140/76; 228/145

[56] References Cited

U.S. PATENT DOCUMENTS

| | | | |
|---|---|---|---|
| 9,369 | 11/1852 | Richards | 140/76 |
| 254,559 | 3/1882 | Lothrop | 140/76 |
| 2,093,810 | 9/1957 | Karmazin | 85/32 CS UX |
| 3,110,755 | 11/1963 | Esser | 174/87 |
| 3,497,607 | 2/1970 | Swanson | 174/87 |
| 3,616,532 | 11/1971 | Beck | 174/68.5 X |

FOREIGN PATENT DOCUMENTS

| | | | |
|---|---|---|---|
| 7,209,607 | 1/1973 | Netherlands | 174/87 |

*Primary Examiner*—Laramie E. Askin
*Attorney, Agent, or Firm*—David Teschner; Jesse Woldman

[57] ABSTRACT

An improved tubular ferrule which may be employed in a wire connector or the like comprises a helical coil of closely wound turns of generally elongate tubular form with each of the turns of the coil being bonded to an adjacent turn to form a crimpable tubular structure having an undulating interior surface and readily adaptable for use as an electrical connector or the like. The individual turns of the coil may be bonded to one another either by the selective application of a bonding material to the coil or by pre-coating the wire with a preferably heat responsive fusible material and subjecting the coil to a heating operation to fuse the turns together. Wire having a circular, rectangular, or other suitable cross section may be employed and selectively oriented to provide a variety of selective interior and exterior surface configurations. The wire may be preworked, prior to winding, to provide sharp protrusions thereon to enhance the engagement between the ferrule and external parts joined thereto.

2 Claims, 11 Drawing Figures

TUBULAR FERRULE

BACKGROUND OF THE INVENTION

1. Field of the Invention

The invention is directed to the field of tubular structures and principally to a uniquely formed crimpable ferrule having a principal use as a connector for electrical conductors and the like.

2. Description of the Prior Art

Prior art metallic ferrules for electrical connection or the like were generally formed from a length of electrically conductive seamless or joined tubing such as copper, aluminum, and other similar non-ferrous materials which were cut to the desired length to provide a crimpable sleeve for attachment to one or more conductors. Another process for forming such tubular sleeves entailed the manufacture of eyelet-like members stamped and drawn from flat stock, with the attendant production of a substantial amount of waste material as a consequence thereof. Due to the rapidly increasing cost of electrically conducting stock material there has been a great need for a low cost tubular ferrule for use in electrical connectors or the like which would be less expensive to manufacture than such prior art devices, yet would perform at least as well in use. A further disadvantage of such prior art devices was the expense and complexity associated with the addition thereto firstly, of internally directed insulation piercing means for piercing the outer covering of insulation or oxide coated wires about which the ferrule was to be crimped and, secondly, of external striations or teeth for gripping an overlying sleeve. In U.S. Pat. No. 3,390,227, issued June 25, 1968 to Shlesinger, Jr. and U.S. Pat. No. 3,333,047, issued July 25, 1967 to Geoffroi, there are disclosed connecting devices utilizing helically coiled wire to form a sleeve-like member. Such devices still failed to provide a suitable substitute for a solid wall tubular sleeve since the turns of wire utilized to form the coil are spaced from one another and, upon compression, provide only a small fraction of the contact area provided by the solid wall tubular sleeve. It should be further noted that such spaced turns will tend to further undesirably separate upon crimping, thereby unpredictiably affecting the integrity of the final joint.

SUMMARY OF THE INVENTION

The invention overcomes the problems and limitations noted above with respect to such prior art devices by providing a tubular ferrule formed from a helical coil of closely wound wire, the adjacent turns of which are bonded one to another to form a tubular structure which is more versatile, economical, and readily manufactured than such prior art devices. In one embodiment the coil is formed from uncoated material and the bonding material selectively applied thereto to provide a relatively rigid, crimpable tubular structure. In another embodiment, the wire from which the coil is formed is selectively precoated with a preferably heat responsive fusible material so that, upon the proper application of heat to the coil, the fusible material may be caused to flow and thereby conveniently bond the individual turns one to another. The coil may be formed from conventional round wire stock which may be fed through a die to cause a series of spaced sharp protuberances to be raised from the surface thereof, which teeth may be thereafter oriented inwardly to provide insulation piercing means along the interior of the coil, and oriented outwardly to increase the retention of the coil within a plastic or insulative sleeve which may be disposed thereover. In another embodiment, generally rectangular or square cross section wire may be employed and selectively obliquely oriented during the winding process such that the sharp edge formed at the juncture between a pair of adjacent surfaces of the wire describes an inwardly directed helix extending radially towards the center of the coil from the inner diameter thereof, while the opposing externally facing edge may be employed to enhance the interengagement between the outer diameter of the coil and an insulative sleeve which may be disposed thereover. It is therefore an object of this invention to provide an improved tubular ferrule.

It is another object of this invention to provide a tubular structure formed from a helically wound coil of wire.

It is still another object of this invention to provide an improved crimpable tubular ferrule for an electrical connector or the like.

It is still a further object of this invention to provide an improved tubular ferrule formed from a helical coil of selectively formed wire, the turns of which may be so oriented as to provide conductor engaging ribs along the inner diameter thereof, and sleeve engaging ribs along the outer diameter.

It is yet another object of this invention to provide a tubular ferrule formed from a helical coil of coated wire wherein adjacent turns of the coil may be bonded to one another by fusion.

Other objects and features will be pointed out in the following description and claims and illustrated in the accompanying drawings which disclose, by way of example, the principle of the invention and the best modes contemplated for carrying it out.

BRIEF DESCRIPTION OF THE DRAWINGS:

In the Drawings.

Similar elements are given similar reference characters in each of the respective drawings.

Figure 1:
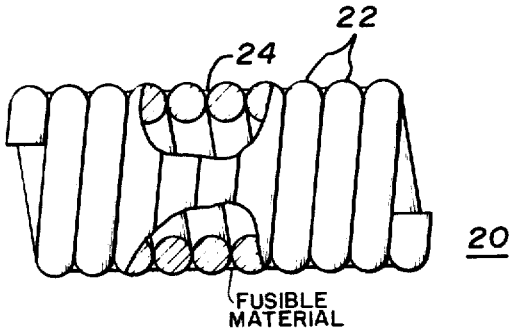
FIG. 1 is a side elevational view, partly cut away and partly in section, showing an improved tubular ferrule constructed in accordance with the concepts of the invention.
Figure 2:
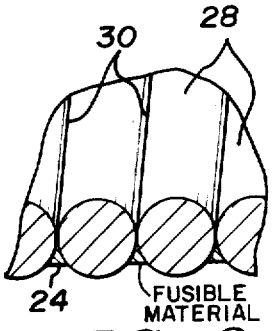
FIG. 2 is an enlarged fragmentary view, partly in section, of a portion of the ferrule of FIG. 1.
Figure 3:
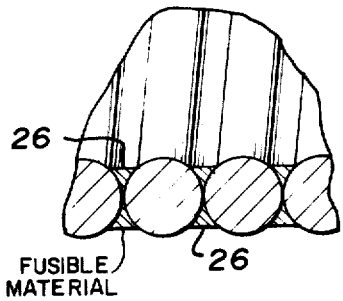
FIG. 3 is an enlarged fragmentary view, partly in section, of a portion of a further embodiment of a tubular ferrule constructed in accordance with the concepts of the invention.
Figure 7:
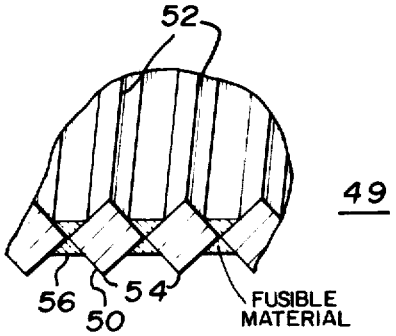
FIG. 7 is an enlarged fragmentary view, partly in section, of a portion of still another embodiment of a tubular ferrule constructed in accordance with the concepts of the invention.
Figure 11:
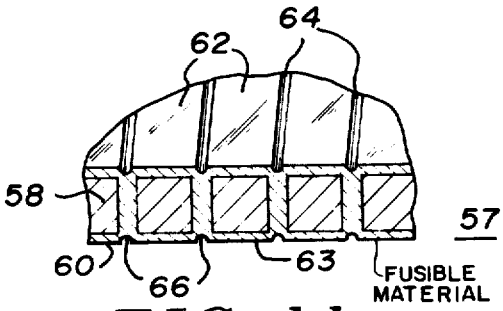
FIG. 11 is an enlarged fragmentary view, partly in section, of a portion of a further embodiment of a tubular ferrule constructed in accordance to the concepts of the invention.

DESCRIPTION OF THE PREFERRED EMBODIMENTS:

Turning now to FIGS. 1 and 2 there is shown a tubular ferrule 20 constructed in accordance with the concepts of the invention. A ferrule 20 comprises a helically wound series of turns 22, each directly abutting an adjacent turn to form a tubular element of the desired length. Although the wire used to form the tubular ferrule 20 is illustrated as having a generally circular cross section, square or rectangular cross section wire, as shown in FIGS. 7 and 11, for example, may be employed to provide differently configured ferrule surfaces, as described in more detail hereafter. Returning now to FIGS. 1 and 2, the ferrule 20 may be formed from either ferrous or non-ferrous metallic material which, in the latter case, may comprise any one of a number of electrically conducting materials such as copper, brass, bronze or aluminum or, in the former case, iron wire, which may be plated with an electrically conducting material such as copper, nickel, brass, or other conventionally employed electrically conducting coatings. After winding, each of the turns 22 is bonded to an adjacent turn by the employment of a fusible material 24 which, although shown disposed over a portion of the exterior of the ferrule 20 in FIGS. 1 and 2, may be applied over selective portions of both the interior and exterior of the insert, as shown at 26 in FIG. 3. It will of course be readily appreciated that the bonding material 24 may be disposed solely along the interior of the coil, or along one portion of the interior and another portion of the exterior of the coil, if necessary or desirable. The interior surface of the ferrule 20 is defined by a series of ridges 28 and valleys 30 (FIG. 2), which significantly increase the extent of engagement between the insert 20 and one or more conductors (not shown) inserted therewithin. As the ferrule 20 is crimped about the enclosed conductors, the valleys 30 provide pockets for the receipt of the displaced conductive material, thereby advantageously increasing the electrical and mechanical engagement between the ferrule and the conductors joined thereto. The application of the bonding material 24 solely to the exterior of the ferrule 20 provides an exterior surface, generally free from the valleys 30 which are found on the interior surface of the ferrule 20. Accordingly, by controlling the quantity of bonding material 24 applied to the coil, the amplitude of the exterior surface undulations may be readily modified. Thus, where an essentially smooth exterior surface is desired, it is merely necessary to provide sufficient bonding material 24 to substantially fill each of the valleys between adjacent turns of the ferrule 20. Where the ferrule 20 is adapted to be used as an electrical connector to be crimped about one or more conductive wires to form an electrical joint thereat, the bonding material 24 and 26 may be selected from the group of lead-tin alloys conventionally employed as a solder or brazing compound in electrical applications. The resulting structure thus closely approximates a solid wall tubular sleeve having a thickness approximately equal to the diameter of the wire employed to form the ferrule 20. The bonded turns 22 are thus securely held together during a crimping operation and will collapse or deform in a manner similar to that of a solid tubular sleeve but without separation of the individual turns, as would be the case with known prior art devices formed from an unbonded coil of wire.

Figure 4:
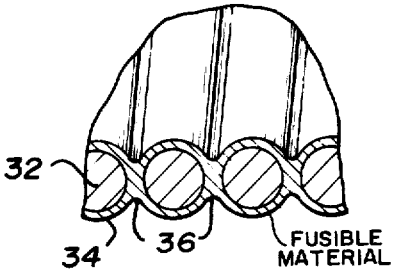
FIG. 4 is an enlarged fragmentary view, partly in section, of a portion of another embodiment of a tubular ferrule constructed in accordance with the concepts of the invention.
Figure 5:
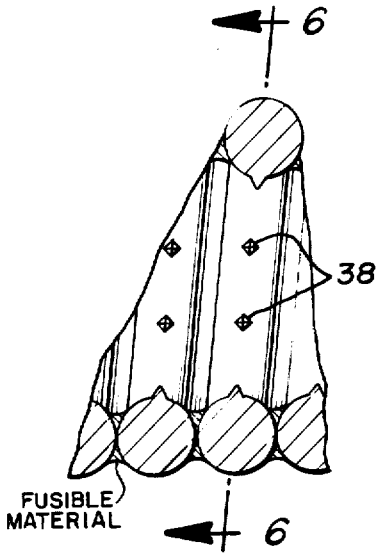
FIG. 5 is an enlarged fragmentary view, partly in section, of a portion of yet another embodiment of a tubular ferrule constructed in accordance with the concepts of the invention.
Figure 6:
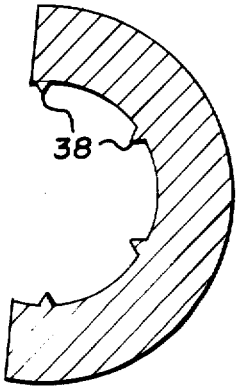
FIG. 6 is a sectional view of the device of FIG. 5 taken along the lines 6-6.
Figure 8:
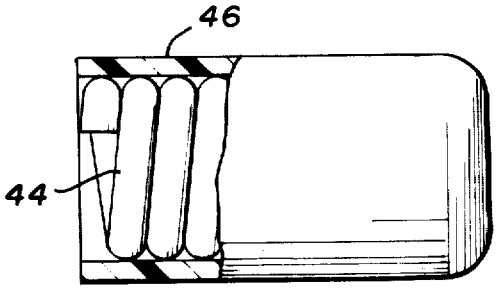
FIG. 8 is a side elevational view, partly cut away and partly in section, of an insulated tubular ferrule constructed in accordance with the concepts of the invention.
Figure 9:
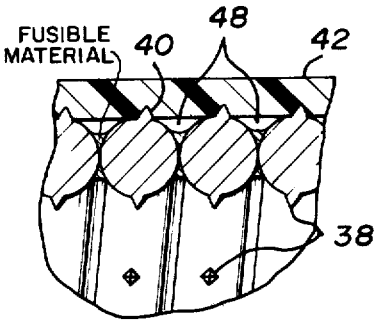
FIG. 9 is an enlarged fragmentary view, partly in section, of a portion of still a further embodiment of an insulated tubular ferrule constructed in accordance with the concepts of the invention.
Figure 10:
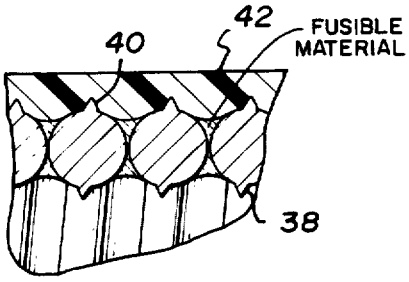
FIG. 10 is an enlarged fragmentary view, partly in section, of the device of FIG. 9, showing a modified arrangement of the insulating portion thereof.

Referring now to FIG. 4 there is shown a tubular ferrule formed from wire 32 having a fusible coating 34 disposed thereover. Each of the turns of wire 32 may thus be conveniently and rapidly bonded to an adjacent turn by the simple expedient of subjecting the wound ferrule to heat of sufficient intensity to cause the fusible coating 34 to flow between the turns, thereby providing an essentially contiguous bond between the adjacent turns. By the employment of pre-coated wires, such as illustrated in FIG. 4, the additional step of adding the bonding material to the interior or exterior of the ferrule after the formation of the coil is thereby eliminated. To further enhance the employment of the tubular ferrule 20 in electrical applications, there may be provided a series of sharp protrusions 38 (FIGS. 5 and 6) initially extending longitudinally along the length of the wire used to form the ferrule, and the wire thereafter wound in such manner as to dispose such protrusions 38 along the interior of the ferrule, as shown in FIG. 5. This may be done simply by passing the uncoiled wire through a set of dies (not shown) suitably formed to raise the projections 38 from the surface of the wire as the wire is passed therethrough. The wire may then be wound in a conventional manner to provide the configuration shown. Thus, upon crimping the ferrule about one or more insulated or oxide coated conductors disposed therewithin the protrusions 38 which, of course, may be selectively formed to provide one or more cutting surfaces, are thus caused to penetrate the outer insulative or oxide coating of the conductor and enter and engage the conductive portion thereof. A further set of protrusions 40, as shown in FIGS. 9 and 10, may be disposed on the exteriorly facing side of the wire to increase the retention between the outer surface of the ferrule and an insulative sleeve such as 42 disposed thereover. The sleeve 42 may be formed from any one of a number of conventionally employed insulating materials such as polyethylene, polypropylene, nylon, PVC, or other suitable plastic materials. The protrusions 40 embed themselves into the sleeve 42 to further increase the engagement between the sleeve 42 and the enveloped ferrul. The exteriorly facing protrusions 40 may, of course, be eliminated and the sleeve 42 disposed over merely the exterior surface of the ferrule which will still provide adequate retention therebetween, as illustrated, for example, in FIG. 8. In FIG. 8 there is illustrated a tubular ferrule 44 essentially duplicative of ferrule 20 illustrated in FIG. 1, but having disposed thereover a closed end insulative sleeve 46 which may be either molded about the ferrule 44, or preformed and then superposed thereover. In the latter case the sleeve 46 is designed preferably to have an internal diameter slightly smaller than the external diameter of the ferrule 44 and of sufficiently resilient material to provide a tight fit between the two members. As indicated above, the sleeve 46 may be molded about the ferrule 44 so that a portion of the material forming the sleeve 46 will flow into the valleys between adjacent turns of the ferrule 44 to provide more intimate engagement between said ferrule 44 and the sleeve 46. In a similar manner the sleeve 42 illustrated in FIG. 9 may be molded about the externally toothed ferrule illustrated therein to form an assembly substantially as shown in FIG. 10, where the forming sleeve 42 occupies substantially the entire external surface of the ferrule.

Turning now to FIG. 7 there is shown a portion of a tubular ferrule 49 constructed in accordance with the concepts of the invention and formed from generally square cross section wire 50. The wire 50 is selectively oriented during the winding process so that one series of sharp edges 52 defining the juncture of a first pair of adjacent surfaces of the wire 50 extend helically within the interior of the ferrule 49 while an opposing series of sharp edges 54 defining the juncture of the remaining pair of adjacent surfaces of wire 50 extend helically around the outer surface of the ferrule. Disposed between each of the turns of the wire 50 is a bonding material 56 essentially similar to that shown in FIGS. 2 and 3 at 24 and 26. Although the individual turns of the wire 50 shown in FIG. 7 are illustrated as being bonded at both the interior and exterior surfaces of the ferrule 49, these turns may be bonded either solely at the exterior surface or the interior surface, as described heretofore, or the wire 50 may be coated as at 34 in FIG. 4 with a fusible material and then subjected to sufficient heat to cause the fusible material to flow in a manner similar to that described above with respect to FIG. 4, to bond adjacent turns one to another. For electrical applications, for example, the wire 50 may be pretinned or coated with a suitable alloy to provide an electrically conductive surface thereabout which may be advantageously employed to protect the wire from further oxidation or corrosion while maintaining an enhanced electrically conductive surface throughout the interior and exterior of the ferrule. It will of course be readily apparent to those skilled in the art that the wire itself may be formed from selectively fusible material so that the addition of further bonding material becomes unnecessary and the individual turns of the coil may be bonded to one another by welding, brazing, or other suitable means. It should of course be recognized that where the ferrule is to be employed as a crimpable connector in electrical applications, fairly ductile wire should be utilized to permit the tubular structure to be readily permanently crimped or deformed into its final shape to provide a tight intimate joint between the ferrule and the enclosed conductors. It may be further noted with reference to the embodiment illustrated in FIG. 7 that the inwardly directed edges 52 may be advantageously utilized as insulation or oxide piercing means, thereby obviating the necessity for providing additional protrusions such as 38 shown in FIG. 9 along the length thereof.

Referring now to FIG. 11 there is shown a further embodiment of a portion of a tubular ferrule 57 formed from generally square cross sectional wire 58 similar to wire 50 but having a coating 60 disposed thereabout essentially duplicative of the coating 34 described with reference to the embodiment illustrated in FIG. 4. In the embodiment illustrated in FIG. 11 the turns of the wire 58 are oriented in such manner as to present juxtaposed abutting surfaces rather than edges, so that the interior and exterior of the ferrule 57 is described essentially by a series of aligned flat surfaces 62, 63, respectively, separated by relatively shallow valleys 64, 66. Thus, the generally serrated interior of the ferrule 57 may be advantageously employed to enhance the retention of a conductor enclosed therewithin, while the generally serrated exterior of the ferrule 57 may be found extremely useful to provide increased engagement with an insulative sleeve such as 46 (FIG. 8) disposed thereabout.

Although there has been shown an essentially uniform diameter ferrule in each of the embodiments heretofore described, it will be readily apparent to those skilled in the art that the configuration of the ferrule may be modified to provide, for example, a generally frusto-conical contour, or variations thereof from the spirit of the invention and within the concepts herein disclosed.

The embodiments of the invention in which an exclusive property or privilege is claimed are defined as follows:

1. A tubular ferrule comprising: a helical coil of wire formed from electrically conducting material and wound so that each of the turns of said coil directly abuts an adjacent turn, said coil having an inner surface and an outer surface, said inner surface of said coil being defined by at least a portion of the inner surface of each of said turns, and said outer surface of said coil being defined by at least a portion of the outer surface of each of said turns; a plurality of spaced, generally sharp protrusions extending generally radially inwardly towards the interior of said coil from said inner surface of each of said turns for engagement with a conductor to be inserted within said ferrule; and bonding means joining adjacent turns together to form a substantially tubular structure, said bonding means joining said turns together adjacent said inner and said outer surface of said coil, said ferrule further comprising a plurality of spaced, generally sharp protrusions extending generally radially outwardly from said outer surface of each of said turns.

2. A tubular ferrule as defined in claim 1 further comprising a sleeve formed from electrically insulative material, and intimately disposed over said coil of wire, said outwardly extending protrusions engaging the inner surface of said sleeve to restrict the removal of said sleeve from said coil.

* * * * *